United States Patent [19]

Matt

[11] Patent Number: 4,500,937

[45] Date of Patent: Feb. 19, 1985

[54] CONTROL CIRCUIT FOR A SOLENOID DRIVER FOR A DISPENSER

[75] Inventor: Timothy S. Matt, Bay Village, Ohio

[73] Assignee: Nordson Corporation, Amherst, Ohio

[21] Appl. No.: 441,241

[22] Filed: Nov. 12, 1982

[51] Int. Cl.[3] ..... H01H 47/32

[52] U.S. Cl. ..... 361/153; 118/682; 118/684; 198/341; 361/159

[58] Field of Search ..... 361/152, 153, 159; 198/341; 118/669, 674, 682, 684, 685

[56] References Cited

U.S. PATENT DOCUMENTS

| | | | |
|---|---|---|---|
| 3,532,907 | 10/1970 | Kasper . | |
| 3,532,990 | 10/1970 | Kasper . | |
| 3,593,308 | 7/1971 | Fagan . | |
| 3,682,131 | 8/1972 | Algeri et al. | 118/682 |
| 3,813,524 | 5/1974 | Coberley . | |
| 3,862,414 | 1/1975 | Algeri . | |
| 4,013,037 | 3/1977 | Warning, Sr. et al. | 118/685 |
| 4,164,001 | 8/1979 | Patnaude | 118/684 X |
| 4,166,246 | 8/1979 | Matt . | |
| 4,380,967 | 4/1983 | Matt | 118/669 |
| 4,389,971 | 6/1983 | Schmidt | 118/669 |
| 4,408,562 | 10/1983 | DeCamp et al. | 118/669 |
| 4,421,800 | 12/1983 | Schoenberg et al. | 118/684 X |

*Primary Examiner*—Reinhard J. Eisenzopf

*Attorney, Agent, or Firm*—Wood, Herron & Evans

[57] ABSTRACT

A control circuit for a solenoid driver for a dispenser having inherent pull-in and drop-out delays. The circuit includes a tachometer that generates pulses representative of the speed of a conveyor that conveys a substrate upon which the dispenser dispenses fluid. A sensor generates a trigger signal indicating that the substrate is at a preselected location. Delay counter circuitry, enabled through the trigger signal, generates an enabling signal after receiving a preselected number of pulses. Duration counter circuitry, enabled by the enabling signal, generates an initial driving signal of a preselected signal duration. Compensator circuitry receives the initial driving signal and modifies it so as to compensate for the pull-in and drop-out delays so that fluid is deposited for the dispensing duration upon the substrate commencing at the preselected position.

7 Claims, 6 Drawing Figures

CONTROL CIRCUIT FOR A SOLENOID DRIVER FOR A DISPENSER

BACKGROUND OF THE INVENTION

The invention relates to a control circuit for controlling the solenoid driver of a dispenser that deposits fluid upon a conveyed substrate. More specifically, the invention relates to such a control circuit that compensates for the pull-in delay and drop-out delay inherent in the dispenser so that the dispenser deposits a bead of fluid commencing at a preselected position for a preselected duration.

In many phases of manufacturing there is a need to activate a responsive device which will act on a moving object. In the packaging or product assembly phases of manufacturing, for example it is often desired to apply a bead of adhesive of a given length to a specific area of an object (or substrate) while the substrate moves on a conveyor past a dispensing device. Generally, the dispenser must be turned on and off at precise times in order to apply the adhesive to the proper area on the object. For ease of understanding, the invention can be described in terms of this one specific application. Many other applications are of course possible.

In order to activate the dispenser in automated systems, a sensor is generally employed to detect the substrate moving on the conveyor. The sensor is generally located to sense the presence of the substrate upstream from the dispenser. Therefore, the activation of the responsive device must be delayed for some period of time after the substrate is sensed, specifically, until the substrate reaches the dispenser. Thereafter, the dispenser is activated for some given duration of time, during which adhesive is applied to the substrate.

The amount of time for which the start of the activating control signal must be delayed and the duration of the activating signal are influenced by many factors such as conveyor speed, distance from the sensor to the dispenser, the distance between the triggering edge of the object and the location on the object which the bead is to start (for turn on) or bead length (for turn off), and the time required for the dispenser to turn on in response to a control signal (hereinafter characterized as "pull-in delay") or drop out in response to removal of the control signal (hereinafter characterized as "drop-out delay"), or other system delays which are constant as a function of time irrespective of conveyor speed.

Each dispenser has an inherent pull-in delay and drop-out delay that is unique to itself. In applications using multiple dispensers that require particularly critical placement of fluid (e.g. hot melt adhesive), it is necessary that the particular delays of each dispenser be compensated for. Systems using a single time (delay-duration) have been unable to compensate for each dispenser. In order to compensate for each individual dispenser, the compensation (or control) circuit for the driver should be physically located at the solenoid driver. This type of compensation cannot easily be done with earlier devices.

In some applications the combination of such factors as dispensing duration and pull-in delay may be such (e.g. dispensing duration less than pull-in delay) that it is impossible for the dispenser to deposit the bead of adhesive in the correct fashion. Earlier devices have been unable to compensate for this sort of problem with the result being that a bead is not deposited.

SUMMARY OF THE INVENTION

The invention is a control circuit for a solenoid driver for a dispenser for dispensing fluid for a preselected dispensing duration upon a conveyed substrate commencing at a preselected position. The dispenser has an inherent pull-in delay and drop-out delay.

The control circuit comprises a tachometer means which is connected to the conveyor and which generates pulses representative of the speed of the conveyor. A sensor means mounted adjacent the conveyor which senses the presence of the substrate at a preselected location. The sensor means generates a trigger signal indicating that the substrate is at the preselected location.

A delay means which is enabled through the trigger signal and which generates an enabling signal after receiving a preselected number of pulses. A duration means which is enabled by the enabling signal and which generates an initial driving signal of a preselected signal duration.

A compensator means which receives the initial driving signal and modifies the commencement and duration of the initial driving signal to compensate for the pull-in delay and drop-out delay of the dispenser.

BRIEF DESCRIPTION OF THE DRAWINGS

Further characteristics and advantages of this invention can be found in the following description of several preferred samples of realization. In these drawings are shown:

FIG. 6 comparatively illustrates the electrical signals to the solenoid driver with the deposit of adhesive by the dispenser for a second example.

DETAILED DESCRIPTION OF A SPECIFIC EMBODIMENT

Figure 1:
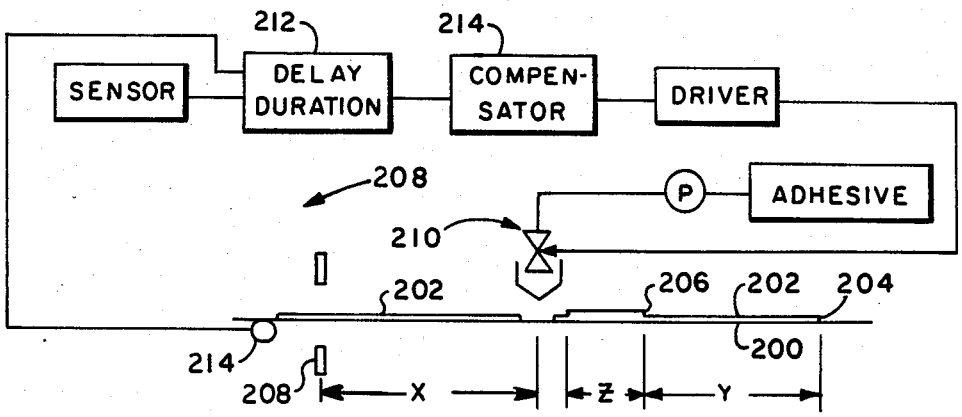
FIG. 1 is a schematic view illustrating an automatic adhesive dispensing system.

Referring to FIG. 1 there is illustrated a conveyor 200. A number of substrates 202 that are to be coated are positioned on the conveyor 200. Each substrate 202 has a leading edge 204 and a specific point 206 thereon at which fluid is initially deposited. Point 206 is a distance Y from leading edge 204. The fluid is deposited for a specific length Z. Sensor 208 and dispenser 210 are spaced a distance X apart. A pulse generator (or tachometer) 214 generates pulses in response to the linear movement of conveyor 200. Broadly speaking, a sensor arrangement 208 detects the presence of substrate 202 at a preselected location along conveyor 200. Sensor arrangement 208 sends a trigger signal to the delay-duration module 212 in response to the presence of the substrate. After a preselected delay, the delay-duration module 212 generates an initial driver signal of a preselected duration. The initial driver signal is received by the compensator module 214. The compensator module 214 then modifies the initial driver signal compensating for the pull-in and drop-out delays of the dispenser 210.

It should be noted that the compensator module 214 may be positioned physically proximate to the driver module. The modified signal is sent to the driver module which then sends a signal activating the solenoid of the dispenser. The fluid dispenser 210 then dispenses fluid onto the substrate commencing at the correct point and lasting for the correct duration.

Figure 3:
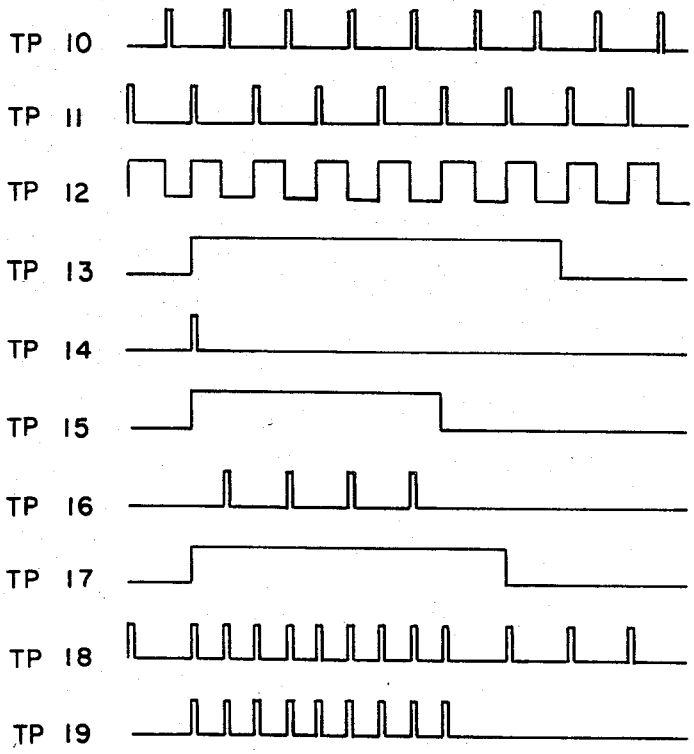
FIG. 3 illustrates the waveforms of the delay-duration timer.
Figure 2:
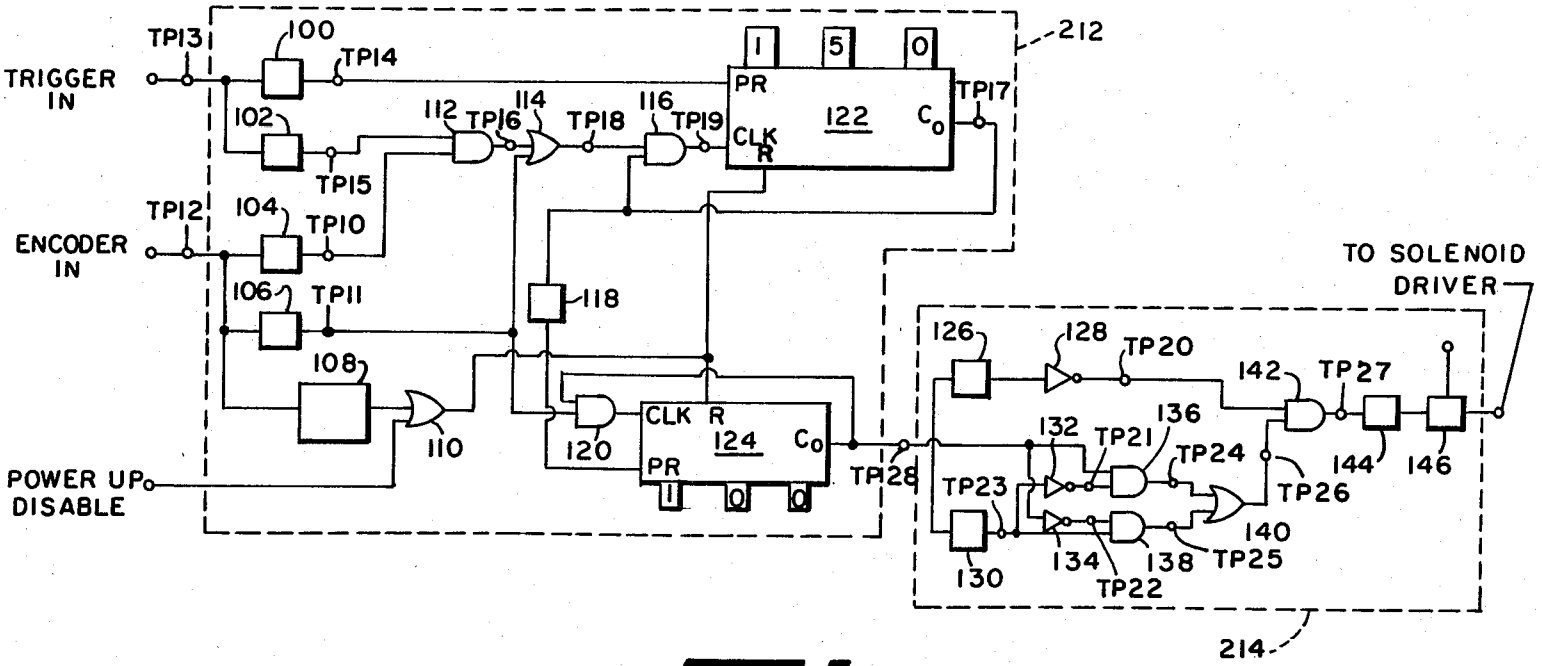
FIG. 2 is a block diagram of the delay-duration timer and the compensation module.

Referring to FIG. 2, the pulses or encoded signal representing linear movement of conveyor 200 are received at the "Encoder In" location and is shown at TP12 in FIGS. 2 and 3. The signal representing the presence of the substrate is received at the "Trigger In" location and is shown at TP13 in FIGS. 2, and 3.

The trigger signal from sensor arrangement 208 is monitored at TP13 and is the sole input to a first single shot 100 which is triggered by the rising edge of the trigger signal to emit a pulse of a relatively shorter duration with respect to the encoded signal at TP12. The output of first single shot 100 is monitored at TP14 and is the enabling input to the delay counter 122.

The trigger signal from sensor assembly 208 is also the sole input to a variable second single shot 102 which is triggered by the falling edge of the trigger signal to emit a signal of a selectively variable duration. The output of variable single shot 102 is monitored at TP15, and comprises one input to a first AND gate 112.

The pulses generated by pulse generator 214 are monitored at TP12. These pulses comprise the sole input to a third single shot 104 (triggered by a falling edge), a fourth single shot 106 (triggered by a rising edge), and a minimum output detector 108. If the encoded signal reflective of the speed of the conveyor is below a certain minimum frequency (e.g. less than 16 Hz) the detector 108 will emit a pulse that is received by second OR gate 110. Second OR gate 110 generates a signal received by both delay counter 122 and the duration counter 124 that disables both counters by providing a high signal to reset input, thus preventing the dispensing of adhesive.

The output from third single shot 104 is monitored at TP10 and is the other input to first AND gate 112. The output from fourth single shot 106 is monitored at TP11, and comprises one input of a first OR gate 114 and one input of a second AND gate 120.

The output from first AND gate 112 is monitored at TP16 and comprises the other input to OR gate 114. The output of first OR gate 114 is monitored at TP18, and comprises one input to third AND gate 116.

The output $C_o$ of delay counter 122 is high upon the enabling of the delay counter at input PR. Delay counter 122 is arranged to count down to zero from a preselected count. The high signal is monitored at TP17 and is received as other input to third AND gate 116. The $C_o$ output of delay counter 122 also comprises the sole input to fourth single shot 118 which is triggered upon the falling edge of the high signal. The emission of a high signal at $C_o$ ends upon counter 122 receiving the preselected number of pulses at the CLK input with the output at $C_o$ returning to a low condition. The output of fourth single shot 118 enables the duration counter 124.

The output $C_o$ of duration counter 124 changes from low to high upon duration counter 124 being enabled. The output is monitored at TP28 and comprises the other input to second AND gate 120, one input to fourth AND gate 136, the sole input to first inverter 134, the sole input to a variable fifth single shot 126 (triggered by a rising edge), and the sole input to a variable sixth single shot 130 (triggered by a falling edge). The fifth and sixth single shots emitting signals of selectively variable durations.

The output of variable fifth single shot 126 comprises the sole input for second inverter 128. The output of second inverter 128 is monitored at TP20 and comprises one input of fifth AND gate 142.

The output of variable sixth single shot 130 is monitored at TP23 and comprises the sole input to a third inverter 132 and one input of a sixth AND gate 138. The output of first inverter 134 is monitored at TP22 and comprises the other input to sixth AND gate 138. The output of third inverter 132 is monitored at TP21 and comprises the other input to fourth AND gate 136.

The outputs of the fourth and sixth AND gates are monitored at TP24 and TP25, respectively, and comprise the inputs to the third OR gate 140. The output of third OR gate 140 is monitored at TP26 and comprises the other input to fifth AND gate 142. The output of fifth AND gate 142 is monitored at TP27 and comprises the sole input to opto-isolator 144. The output of opto-isolator 144 comprises the sole input to switch 146 which outputs to the solenoid driver of the dispenser.

In operation, conveyor 200 conveys substrates 202 past sensor arrangement 208 and dispenser 210 at a particular speed. As conveyor 200 moves, the encoder input is receiving a pulse train from pulse tachometer 214 (see TP12 on FIGS. 2 and 3). These pulses are received by third single shot 104 which generates a pulse at the falling edge of each input pulse (see TP10 in FIGS. 2 and 3). These pulses from third single shot 104 are received by first AND gate 112.

Pulses generated by the pulse tachometer 214 are also received by fourth single shot 106 which generates a pulse at the rising edge (see TP11 in FIGS. 2 and 3). Single shot 106 sends pulses to first OR gate 112 and second AND gate 120.

When sensor arrangement 208 detects the presence of substrate 202 at a preselected location, a trigger signal is received from the sensor at the "Trigger In" (see TP13 in FIGS. 2 and 3). The trigger signal has a duration equal to the length of the substrate. Single shot 100 generates a pulse at the rising edge of the trigger signal (see TP14 and FIGS. 2 and 3) which is received by delay counter 122 to enable delay counter 122.

When counter 122 is enabled a continuous high signal is generated at output $C_o$ (see TP17 and FIG. 3). This high signal is received by one input of third AND gate 116 and fourth single shot 118. Since fourth single shot 118 is triggered by the falling edge no signal is immediately generated.

In response to the rising edge of the trigger signal, variable second single shot 102 generates a signal of a selectively variable duration (see TP15 and FIGS. 2 and 3). This signal is received by one input of first AND gate 112. The inputs to first AND gate 112 have been previously discussed so that it is understood that first AND gate 112 generates pulses at the falling edge of each pulse generated by the pulse tachometer during the duration of the signal generated by second single shot 102. These signals from first AND gate 112 (see TP16 and FIGS. 2 and 3) are received by one input of first OR gate 114.

The inputs to first OR gate 114 have been previously discussed so that it is understood that first OR gate 114 generates pulses at the falling and trailing edges of each pulse generated by the pulse tachometer during the duration of the signal generated by single shot 102 (see TP18 and FIGS. 2 and 3). These pulses are received by one input of third AND gate 116.

The inputs to third AND gate 116 have been previously discussed so that it is understood that until delay counter 122 counts down to zero from its preselected count number, third AND gate 116 will generate pulses (1) at the leading edge of each pulse generated by the pulse tachometer, and (2) at the falling edge of each pulse generated by the pulse tachometer only during the duration of the signal emitted by variable solenoid single shot 102. The duration of the signal emitted by single shot 102 is selected to be equal or greater than the sum of the pull-in delay and drop-out delay. Thus, the overall effect of the abovedescribed circuitry is to accelerate in actual time (or shift to the left as shown at Line D in FIG. 5) the count down of delay counter 122. The duration of the acceleration is equal to the duration of the signal emitted by single shot 102.

Upon delay counter 122 counting down to zero, the output at $C_o$ goes low since the counter has not again been enabled. When this occurs, third AND gate 116 no longer generates pulses, and fourth single shot 118 generates a pulse at the falling edge of the high signal from $C_o$ enabling duration counter 124.

Figure 4:
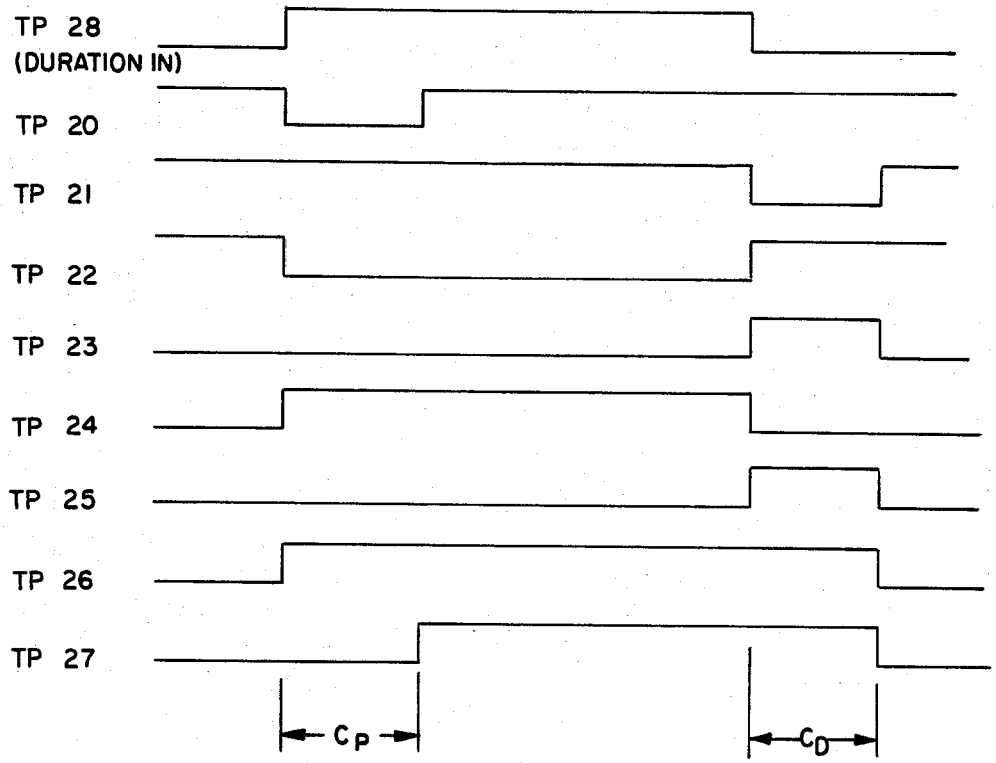
FIG. 4 illustrates the waveforms of the compensation module.

Upon duration counter 124 being enabled, $C_o$ (of duration counter 124) changes from a low to a high signal (see TP28 and FIGS. 2 and 4). In addition to several locations in the compensator module 214, the high signal is received by second AND gate 120. The inputs to second AND gate 120 have been previously discussed so that it is understood that second AND gate 120 now generates pulses at the rising edge of each pulse generated by pulse tachometer until the duration counter counts down to zero from a preselected number of counts at which time $C_o$ becomes low.

Upon duration counter 124 counting down to zero the output at $C_o$ goes low. As illustrated (at TP28) in FIGS. 2 and 4 and previously discussed, the high signal (or initial driving signal) received by the compensator module lasts for a preselected duration. This high signal is received by the compensator module, and more specifically, by the variable fifth single shot 126, variable sixth single shot 130, fourth AND gate 136, and first inverter 134.

The variable fifth and sixth single shots 126 and 130 provide the adjustment feature that compensates for the pull-in and drop-out delays of the dispenser. These features will be discussed in more detail hereinafter. Variable fifth single shot 126 subtracts time equal to the drop-out delay from the commencement of the initial driving signal and variable sixth single shot 130 adds time (or prolongs the signal duration) equal to the pull-in delay to the initial driving signal. The final effect of the subtraction is shown at Line E in FIG. 5 and the final effect of the addition is shown at Line F in FIG. 5.

Upon receiving the initial driving signal, fifth single shot 126 is triggered by the leading edge thereof to generate a signal for a duration of $C_p$ with equals the drop-out delay. This high signal is received and inverted by second inverter 128 so that a low signal is generated by second inverter 128 for a duration of $C_p$ (see TP20 and FIGS. 2 and 4). This low signal is received as one input of fifth AND gate 142.

The initial driving signal is also received by variable sixth single shot 130 which at the falling edge of the initial driving signal generates a signal for a duration of $C_o$ (of duration counter 124) which equals the pull-in delay (see TP23 and FIGS. 2 and 4). The output from variable sixth single shot 130 is received by sixth AND gate 138 and third inverter 132. Third inverter 132 inverts the initial low signal from sixth single shot 130 to a high signal which is received by sixth AND gate 136 (see TP21 and FIGS. 2 and 4).

The initial driving signal is directly received by fourth AND gate 136. Thus, fourth AND gate 136 generates a high signal for the duration of the initial driving signal i.e. TP24 is substantially identical to TP 28. The output of fourth AND gate 136 is received by third OR gate 140.

The initial driving signal is also directly received by first inverter 134 which inverts, and thus, generates a low signal for the duration of the initial driving signal (see TP25 and FIGS. 2 and 4). The output of first inverter 134 is received by sixth AND gate 138.

Third OR gate 140 receives a high signal from fourth AND gate 136 for the duration of the initial driving signal. Thus, third OR gate 140 generates a high signal for the duration of the initial driving signal plus at time $C_o$. This high signal is received by one input of fifth AND gate 142.

The inputs of fifth AND gate 142 have previously been discussed so that it is understood that fifth AND gate 142 generates a high signal beginning at a time $C_p$ after the commencement of the initial driving signal and ending a time $C_o$ (of duration counter 124) after the initial driving signal ends (see TP27 and TP28 and FIGS. 2 and 4). This modified driving signal is passed through an optical isolator 144, and a switch 146, and finally to the solenoid driver circuitry for a solenoid-operated dispenser.

The solenoid driver circuitry may be like that described in U.S. patent application Ser. No. 301,731, Filed Sept. 16, 1981 for a CONTROLLED CURRENT SOLENOID DRIVER CIRCUIT by Merkle and Price. The dispenser is a solenoid valve type dispenser such as that described in U.S. Patent Application Ser. No. 301,731 and U.S. Pat. No. 3,811,601 issued on May 21, 1974 for a MODULAR SOLENOID-OPERATED DISPENSER both of which are assigned to the assignee of this patent application. The dispenser may also be fluid regulated with the regulating fluid controlled by a solenoid valve. Thus, the inherent delays in start-up and shut-down of the dispenser and be compensated for so as to allow the dispenser to deposit a precisely controlled bead of adhesive to a substrate.

A couple of examples are set forth below that illustrate the invention. In the first example, the delay setting for the delay counter (122) equals 150 counts which compensates for the time delay between when the sensor arrangement senses the substrate and when the substrate is correctly positioned with respect to the dispenser. The duration setting for the duration counter 124 equals 100 counts which corresponds to the time the dispenser should be dispensing. The line speed is 300 meters per minute which gives an encoder output of 5 pulses/MSEC. The dispenser has a pull-in delay of 10 MSEC and a drop-out delay of 5 MSEC.

Figure 5:
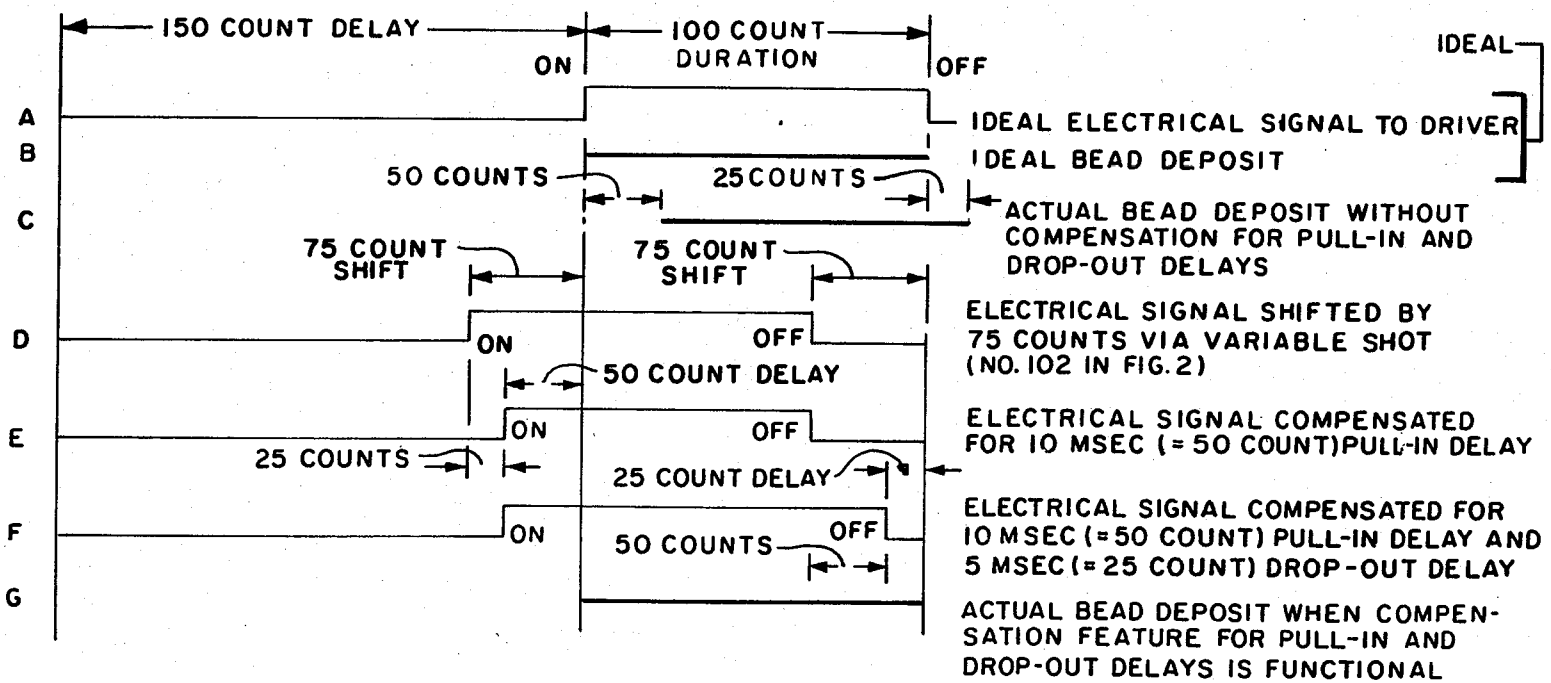
FIG. 5 comparatively illustrates the electrical signals to the solenoid driver with the deposit of adhesive by the dispenser for one example.
Figure 5:
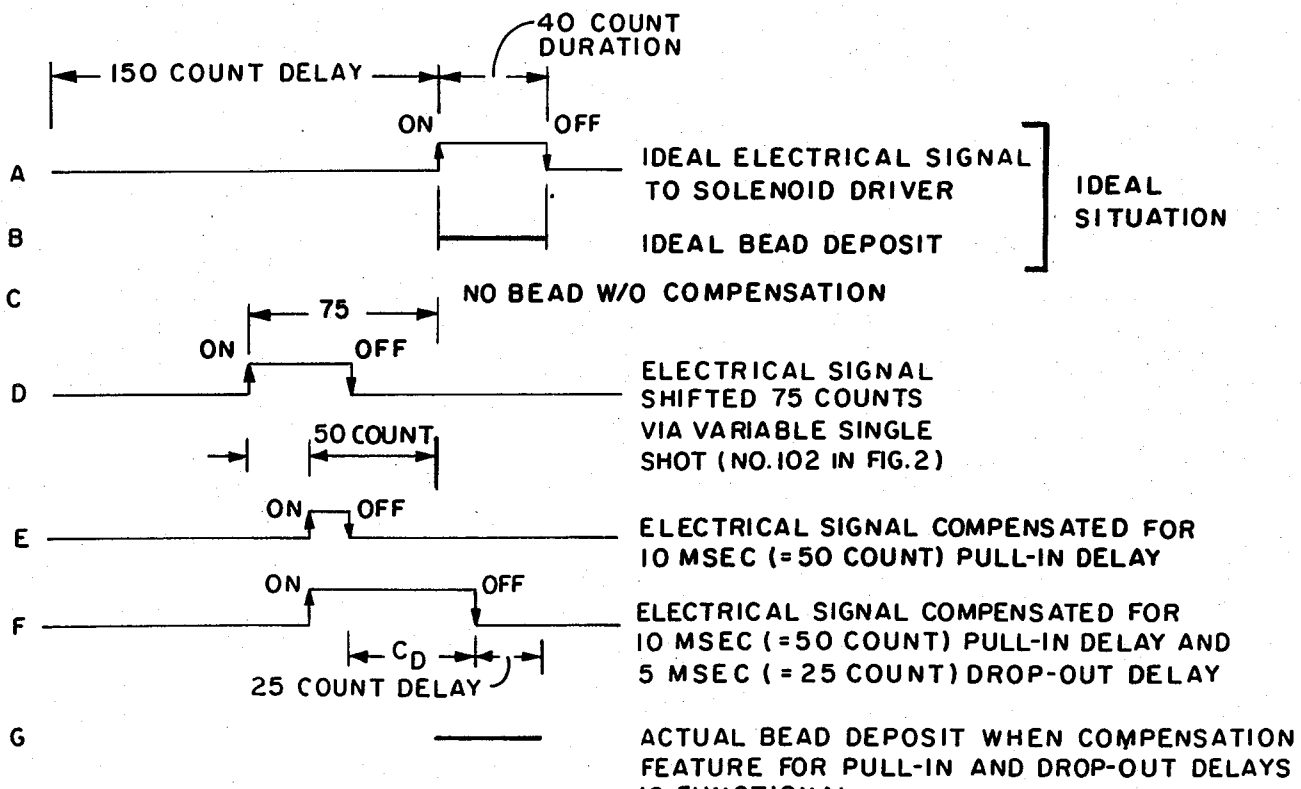

Referring to FIG. 5, if the dispenser had no pull-in or drop-out delay the relationship between the electrical signal to the solenoid driver and the dispensing duration would correspond precisely as shown in Lines A and B of FIG. 5. However, because of pull-in and drop-out delays, absent compensation of the signal to the solenoid driver the bead will be shifted as shown in Line C.

The delay-duration module takes the input from the sensor arrangement and pulse tachometer and through the double counting technique shifts the electrical signal 75 counts (sum of pull-in and drop-out delays) to the left. See Line D in FIG. 5.

The compensator module receives the initial driving signal illustrated in Line D. By setting variable fifth single shot 126 to generate a signal of 5 MSEC (or 25 counts), the commencement of the signal to the solenoid driver is delayed 25 counts. By setting variable sixth single shot 130 to generate a signal of 10 MSEC (or 50 counts), the duration of the signal to the solenoid driver is extended 25 counts. The result being that the bead is deposited at precisely the correct time and for the correct duration.

A second example is shown in FIG. 6. The parameters are:

Line Speed=300 m/min.=5 counts/MSEC
Delay Setting=150 counts
Duration Setting=40 counts (or 8 MSEC)
Pull-In Delay=10 MSEC
Drop-Out Delay=5 MSEC In this situation unless the electrical signal to the solenoid driver is modified the dispenser will not dispense when the duration is less than the pull-in delay. However, when the electrical signal is compensated the dispenser will dispense since the signal received by the solenoid driver has a duration greater than 8 MSEC (=40 Counts). The operation of the circuit on the electrical signal is described below.

As illustrated in Line D of FIG. 6, the delay-duration module shifts the entire signal 75 counts (=15 MSEC) forward or to the left in FIG. 6 with signal maintaining the duration of 40 counts. As illustrated in Line E of FIG. 6, the signal of Line D (initial driving signal) is modified for the pull-in delay so that the commencement of the signal is delayed or shifted 25 counts (=5 MSEC) to the right in FIG. 6. As illustrated in Line F, of FIG. 6, the signal of Line E is modified for the drop-out delay so that the duration extends for an additional 50 counts (=10 MSEC). The result being that the electrical signal is like that in Line F and the bead is correctly deposited as shown in Line G.

While I have disclosed specific embodiments of my invention, persons skilled in the art to which this invention pertains will readily appreciate changes and modifications which may be made in the invention. Therefore, I do not intend to be limited except by the scope of the following appended claims.

What is claimed is:

1. A control circuit for a driver for a dispenser having an inherent pull-in delay and drop-out delay, for dispensing fluid for a preselected dispensing duration upon a substrate conveyed by a conveyor commencing at a preselected position, comprising:

encoder means for generating a pulse signal representative of conveyor distance traveled per unit time;

sensor means for sensing the presence of a conveyed substrate at a preselected location and for generating a trigger signal indicating a substrate is at the preselected location;

delay means, enabled through the trigger signal and connected to receive said pulse signal, for generating an enabling signal after a first preselected number of pulses, said delay means including a delay counter enabled through the trigger signal and generating the enabling signal after receiving a preselected number of pulses, and further including accelerator means, receiving inputs from said encoder means and sensor means for accelerating the generation of pulses to said delay counter so as to advance the generation of the enabling signal a predetermined period of time;

duration means, enabled by the enabling signal and connected to receive said pulse signal, for generating an initial driving signal of a preselected signal duration reflective of a second preselected number of pulses; and compensator means, receiving the initial driving signal, for modifying the commencement and duration of the initial driving signal to compensate for the dispenser pull-in and drop-out delays to produce a driver signal couplable to a driver so that fluid is deposited for the dispensing duration upon a substrate commencing at the preselected position.

2. The control circuit of claim 1 wherein the predetermined period of time is equal to the sum of the pull-in delay and drop-out delay of the dispenser.

3. The control circuit of claims 1 or 2 wherein said compensator means includes:

commencement means, receiving the initial driving signal, for delaying the commencement of said initial driving signal;

duration means, receiving the initial driving signal, for extending the signal duration of the initial driving signal; and combination means, receiving the output of said commencement and duration means, for generating a modified driving signal having a delayed commencement and extended duration relative to the initial driving signal.

4. The circuit of claim 3 wherein said commencement means delays the initial driving signal for a period of time equal to the drop-out delay, and said duration means extends the signal duration of the initial driving signal for a period of time equal to the pull-in delay.

5. A control circuit for a dispenser driver which is responsive to a driving signal, wherein the dispenser has an inherent pull-in delay and drop-out delay time and dispense fluid for a preselected dispensing duration upon a substrate conveyed by a conveyor commencing at a preselected position, comprising:

encoder means for generating a movement signal representative of conveyor speed;

sensor means for sensing the presence of a substrate and for generating a trigger signal indicating a substrate is a preselected distance from the dispenser;

delay-duration means, enabled through the trigger signal and connected to receive the movement signal, for generating an initial driving signal of the preselected dispensing duration, the generation of which occurs a preselected time prior to a substrate being conveyed before the dispenser; and compensator means, receiving the initial driving signal, for generating a driving signal couplable to the dispenser driver, said compensator means including means for delaying the commencement of the driving signal a time, equal to the drop-out delay, from the receipt of said initial driving signal and extending the duration of the driving signal a time, equal to the pull-in delay, from the end of the duration so as to compensate for the pull-in delay and drop-out delay of the dispenser so that fluid is deposited for the dispensing duration upon a substrate commencing at the preselected position.

6. The circuit of claim 5 wherein said compensator means is positioned physically proximate to the driver.

7. The circuit of claim 5 wherein the initial driving signal is generated a preselected time prior to the commencement of an ideal driving signal wherein the preselected time is equal to or greater than the sum of the pull-in and drop-out delays.

* * * * *